US010350502B2

(12) United States Patent
Nelson et al.

(10) Patent No.: US 10,350,502 B2
(45) Date of Patent: Jul. 16, 2019

(54) MULTIFUNCTIONAL SLIDE AND LADDER DEVICE

(71) Applicants: Trena Nelson, Kuna, ID (US); Andrew Richard Nelson, Kuna, ID (US)

(72) Inventors: Trena Nelson, Kuna, ID (US); Andrew Richard Nelson, Kuna, ID (US); Daniel Snow, Provo, UT (US)

(73) Assignees: Trena Nelson, Kuna, ID (US); Andrew Richard Nelson, Kuna, ID (US)

( * ) Notice: Subject to any disclaimer, the term of this patent is extended or adjusted under 35 U.S.C. 154(b) by 0 days.

(21) Appl. No.: 15/855,935

(22) Filed: Dec. 27, 2017

(65) Prior Publication Data

US 2018/0178134 A1 Jun. 28, 2018

Related U.S. Application Data

(60) Provisional application No. 62/439,403, filed on Dec. 27, 2016.

(51) Int. Cl.
*A63G 21/00* (2006.01)
*A63G 21/04* (2006.01)
(Continued)

(52) U.S. Cl.
CPC ..... *A63G 21/04* (2013.01); *A63G 21/00* (2013.01); *A63G 31/00* (2013.01); *A63G 31/14* (2013.01)

(58) Field of Classification Search
CPC ..... A63G 21/04; A63G 21/00; A63G 31/00; A63G 31/14
See application file for complete search history.

(56) References Cited

U.S. PATENT DOCUMENTS 1,573,987 A 2/1926 West
5,718,637 A * 2/1998 Rodriguezx-Ferre ..... A63G 21/00 472/116

(Continued)

FOREIGN PATENT DOCUMENTS

CN 204017245 U 12/2014

OTHER PUBLICATIONS

Internet images for various slide products, Mar. 11, 2016.

*Primary Examiner* — Michael D Dennis
(74) *Attorney, Agent, or Firm* — Pedersen & Company, PLLC; Ken J. Pedersen; Barbara S. Pedersen

(57) ABSTRACT

The multifunctional device has slide and ladder portions easily connectable for use together as a self-supporting unit, and easily detachable for use separately on other equipment or for compact storage or transport. When set-up for use as a self-supporting unit, the ladder and slide portions are hooked together by a double-hook/double-axle connection system that does not allow the angle between the ladder and slide to change any significant amount during normal use of the set-up device. Yet, quick disconnection may be done when the weight of the user is removed, by purposely lifting and pivoting the portions, and then unhooking their top ends from each other. When disconnected from each other, the ladder and/or the slide portion (and preferably both) may be connected/hooked to another object(s), for example, a trampoline or a play equipment platform or other specially-adapted elevated structure, for climbing up to, and sliding down from, said trampoline/platform.

9 Claims, 13 Drawing Sheets

(51) Int. Cl.
*A63G 31/00* (2006.01)
*A63G 31/14* (2006.01)

(56) References Cited

U.S. PATENT DOCUMENTS

| | | | | |
|---|---|---|---|---|
| 5,810,695 | A | 9/1998 | Sass | |
| 7,481,741 | B1 | 1/2009 | Sammann et al. | |
| D601,220 | S | 9/2009 | Sammann et al. | |
| 7,662,045 | B2 | 2/2010 | Sammann et al. | |
| 8,597,132 | B2 | 12/2013 | Brown et al. | |
| 2003/0196580 | A1 | 10/2003 | Broderick et al. | |
| 2006/0189443 | A1 * | 8/2006 | Finlinson ..... | A63B 5/11 482/29 |

* cited by examiner

MULTIFUNCTIONAL SLIDE AND LADDER DEVICE

This application claims benefit of Provisional Application Ser. No. 62/439,403, filed on Dec. 27, 2016 and entitled "MULTIFUNCTIONAL SLIDE AND LADDER DEVICE", the entire disclosure of which is incorporated hereby by this reference.

FIELD OF THE TECHNOLOGY

The Multifunctional Slide and Ladder Device relates to play and exercise devices for children and others who want recreation and/or exercise. More specifically, the preferred device includes a ladder portion and a slide portion that can be: 1) connected together at their top ends, to form a self-standing slide with its own ladder for climbing to the slide-top, and/or 2) disconnected from each other for separate use of the ladder and the slide. The disconnected ladder portion and slide portion may be used at a distance from each other, preferably with each connected at its top end to the same object or equipment. For example, each portion may be connected to a trampoline or to one or more other platforms raised above the ground/floor, so that a user may climb to one region of a trampoline or other platform and then slide down from another region of the trampoline or other platform.

SUMMARY

The invented device and methods for using the device may be considered playground equipment, toys, recreation or exercise devices, and/or devices for climbing up to an elevated level, climbing down from an elevated level, and/or sliding down from an elevated level. Certain embodiments comprise multiple portions that are easily connectable for use together as a unit, and easily detachable for use separately or for compact storage or transport. In certain embodiments, subcomponents of one or more of said multiple portions may also be disconnected/disassembled from each other to further enhance compact storage or transport. Therefore, preferred embodiments of the invention may include one or more of: ladder and slide portions that are connectable for use as a unit, ladder and slide portions that are disconnectable for use separately, and/or ladder and/or slide portions that may be disassembled into two side pieces plus one or more central portions between the two side pieces. For example, certain embodiments of the ladder portion may be disassembled into two side pieces plus multiple steps. For example, certain embodiments of the slide portion may be disassembled into two side pieces plus the main slide-plate.

A ladder portion comprises left and right sides, and steps that cooperate with said left and right sides, to form a rigid, safe, and durable ladder. The steps preferably are removable from the left and right sides for disassembly, to "breakdown" the ladder portion into a set of pieces that can be stacked or otherwise stored in a small space or transported in a small package.

The slide portion comprises a main slide body or "slide plate" with an upper slide surface that is generally or substantially smooth, for serving as a slide as is well-known in the field of playground equipment. The slide portion also comprises left and right sides or other upending handrails/ridges, which are preferably rigidly fixed to the slide plate. Preferably, the left and sight sides/handrails/ridges are permanently fixed to the slide plate, but in some embodiments the slide portion may be adapted for disconnection of the sides/handrails/ridges from the slide plate for compact storage and/or transport. The upper slide surface preferably has an undulating or wavy contour, for providing some control of the speed of the slider and/or for providing interest or fun in the sliding experience.

When set-up for use as a single unit, the preferred ladder and slide portions are hooked together by a secure and safe connection system that does not allow the angle between the ladder and slide to change significantly during normal use of the set-up device. For example, the connection system is adapted to limit change of the angle between the ladder and slide during normal use of the set-up device to less than 5 degrees, less than 4 degrees, less than 3 degrees, less than 2 degrees, less than 1 degrees, or less than 0.5 degrees, or 0.0 degrees. Preferably, the connection system is adapted to allow no change, or at most 1-degree change, in said angle between the ladder and slide during normal use, while still being adapted to allow easy disconnection of the ladder and slide when not in use.

The preferred connection system allows quick connection and disconnection, especially when the weight of the user is removed and a person purposely lifts and pivots the portions relative to the other to purposely disconnect the connection hook system. Typically, small children will not have the strength and agility to disconnect the slide portions. Further, it is very unlikely that the hook system could disconnect while a user's weight is on the unit, and very unlikely that any user that is standing or sitting on the unit could himself/herself disconnect the hook system. Therefore, the preferred embodiments are especially useful as a family or daycare playground/back-yard recreational device, as the preferred combined ladder and slide unit may provide hours of safe sliding fun.

When disconnected from each other, the ladder portion and/or the slide portion may be connected to another object (s), for example, a trampoline or a play equipment platform or other specially-adapted elevated structure, for climbing up to and/or sliding down from, said trampoline/platform. A conventional trampoline has a support frame that holds the trampoline fabric at an elevated level, the support frame comprising a horizontal bar encircling and supporting the trampoline fabric, for example, encircling the springs or other connectors that connect/hook the trampoline to the horizontal bar. Substantial portions of the bar are typically exposed and accessible at the outer perimeter of the trampoline. The hinge portion of each of the ladder portion and the slide portion may engage said bar by hooking over the bar. Thus, the ladder portion may be hooked onto the trampoline bar at one location on the trampoline perimeter and the slide portion may be hooked onto the trampoline bar at another location on the trampoline perimeter. Similarly, a playground equipment platform, or other elevated structure, that is adapted to have a horizontal bar or other bracket fixed to an edge(s) of the platform/structure, and the ladder and slide hook portions may hook-over or otherwise engage the bar/bracket.

Thus, the ladder portion and the slide portion may each be installed at different places on the outer perimeter/edge of the trampoline/platform, to allow a user to easily and safely climb up to the top of the trampoline/platform, and then to easily and safely slide down to the ground/floor. This is especially important for younger users, and will help prevent accidents, because the ladder and slide are installed to be secure and safely attached, and at safe angles relative, to the generally horizontal plane of the trampoline/platform and the generally horizontal plane of the ground/floor.

Thus, both the ladder portion and the slide portion will help prevent risky or "wild" mounting onto a trampoline and risky or "wild" dismounting from the trampoline. The ladder and slide portions will help prevent the user from tumbling off the trampoline and/or getting a foot caught in/on the trampoline support frame structure or gaps therein. For example, prevention of these actions/accidents are helped by each of the ladder and slide preferably having handles at its top end that protrude above the plane of the trampoline and that are easily assessable to the user to stabilize the user during mounting and dismounting. The ladder portion and/or slide portion will relieve much of the anxiety and work involved in a parent, or a daycare provider or other supervisor, helping a child up on top of, and down from, the trampoline. Further, when a child and parent/supervisor know that the child can easily and safely climb up to, and slide down from, the trampoline, the child will be naturally encouraged to leave the trampoline when the child needs a rest or a break from the activity. Overall, safety and good habits will be encouraged.

BRIEF DESCRIPTION OF THE DRAWINGS

FIGS. 9 and 10 detail the connection system of the embodiment of FIG. 1, wherein FIG. 9 and FIG. 10 are right side, rear perspective views of the top end of the ladder portion and slide portion, respectively, disconnected from each other.

DETAILED DESCRIPTION OF CERTAIN EMBODIMENTS

By referring to the Figures, one may see several, but not the only, embodiments of the disclosed Multifunctional Slide and Ladder Device and some but not all methods of using the device. The device and its components are adaptable to function in multiple ways and for multiple purposes. In the assembled, self-standing and self-supporting, deployed configuration of the combined ladder and slide unit 10 in FIGS. 1-8, the two main portions of the device, a ladder portion 20 (or simply "ladder" 20 hereafter and in the claims) and a slide portion 40 (or simply "slide" 40 hereafter and in the claims) are detachably connected together by a connection system that prevents pivoting of the ladder and slide relative to each other during normal use of the deployed unit.

Figure 1:
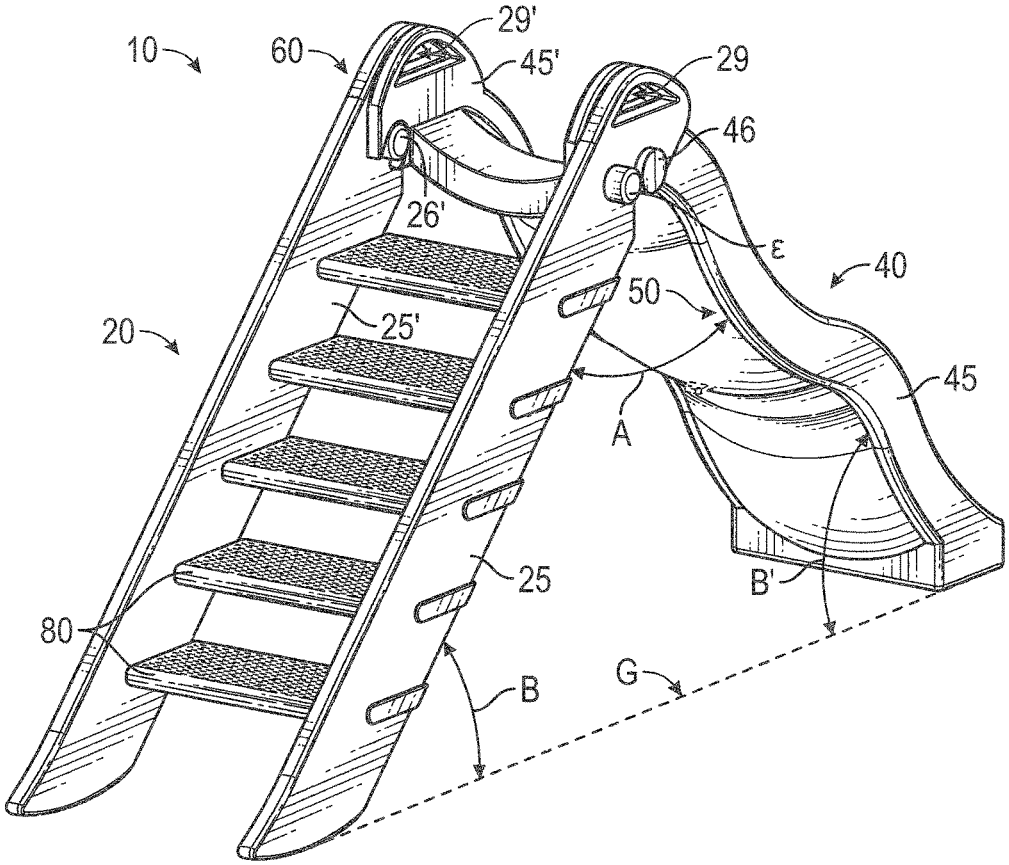
FIG. 1 is a right side, rear perspective view of a combined ladder and slide unit deployed for use, according to one embodiment of the invention.
Figure 2:
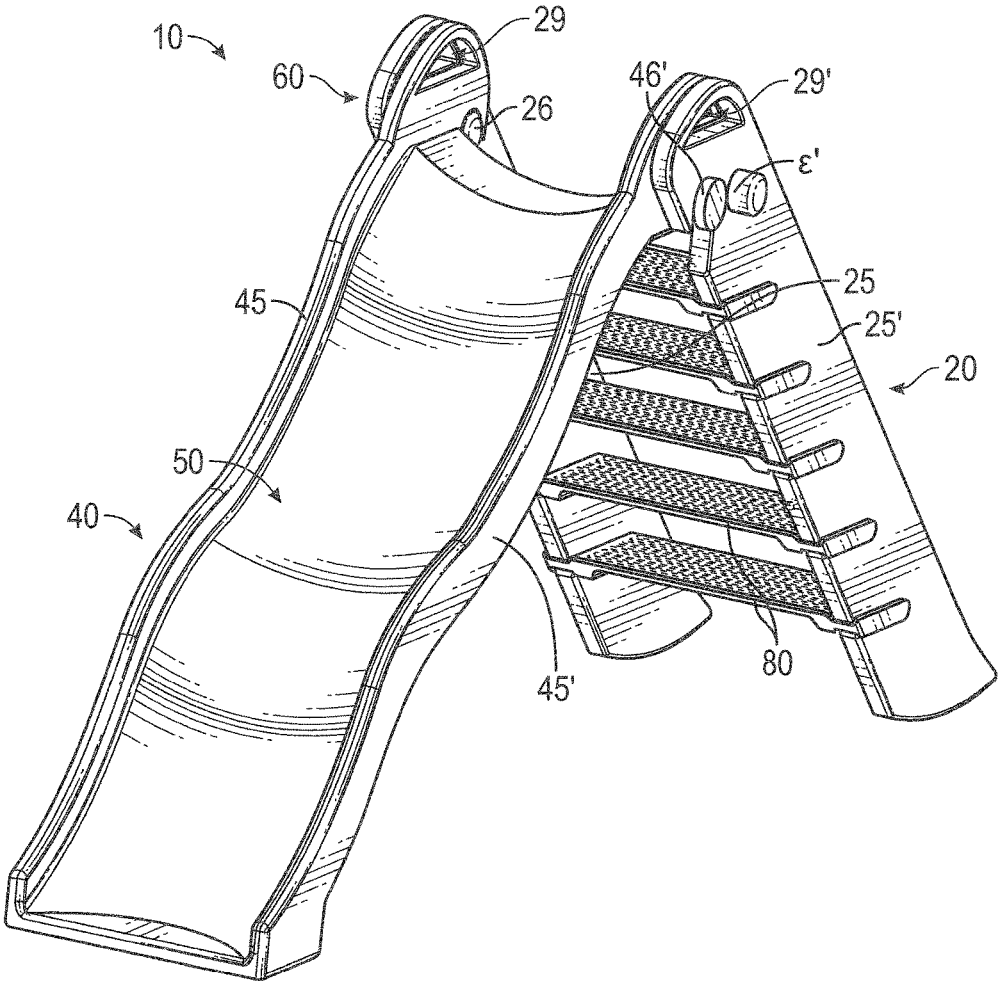
FIG. 2 is a left side, front perspective view of the combined ladder and slide unit of FIG. 1.
Figure 3:
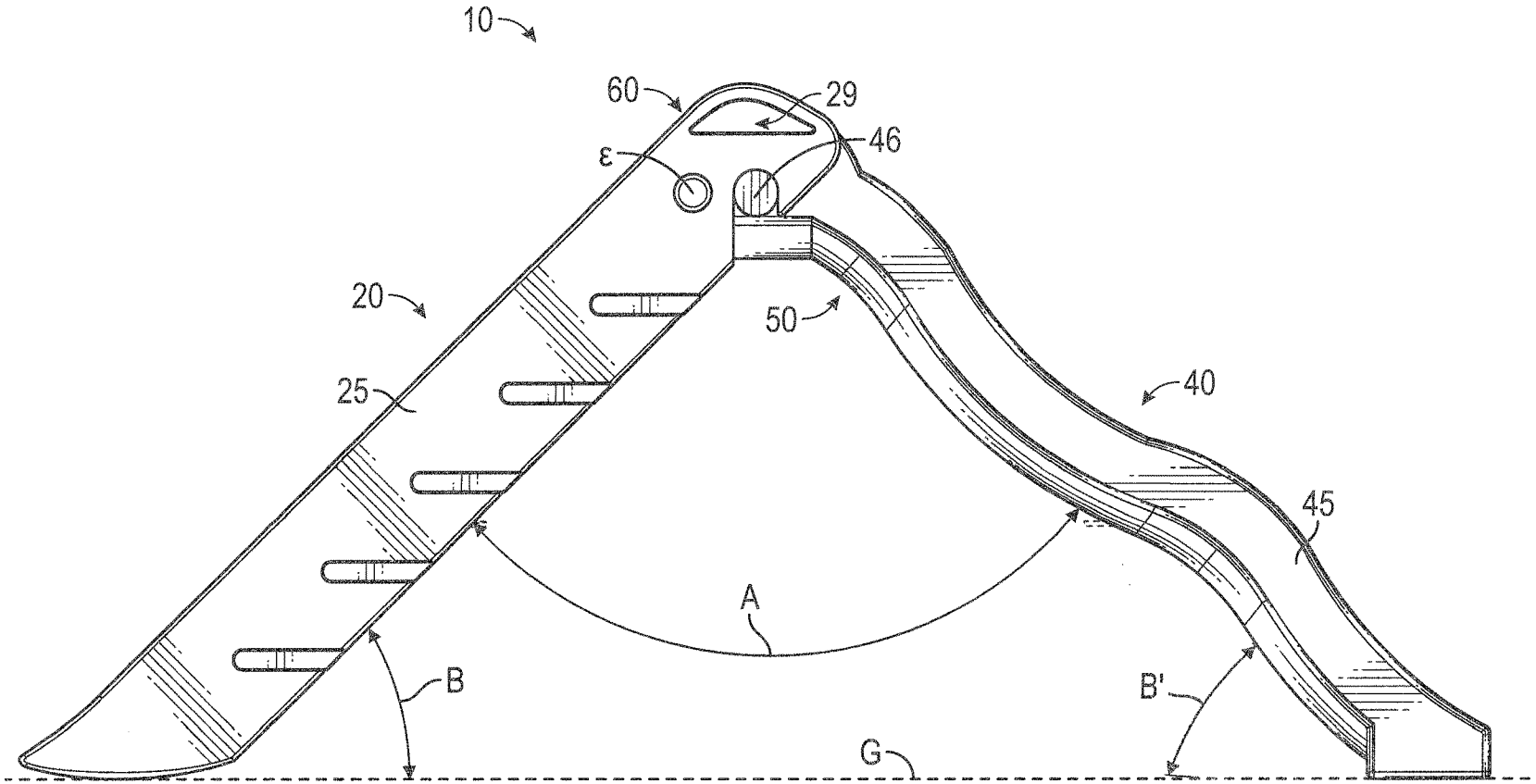
FIG. 3 is a right side view of the combined ladder and slide unit of FIG. 1.
Figure 4:
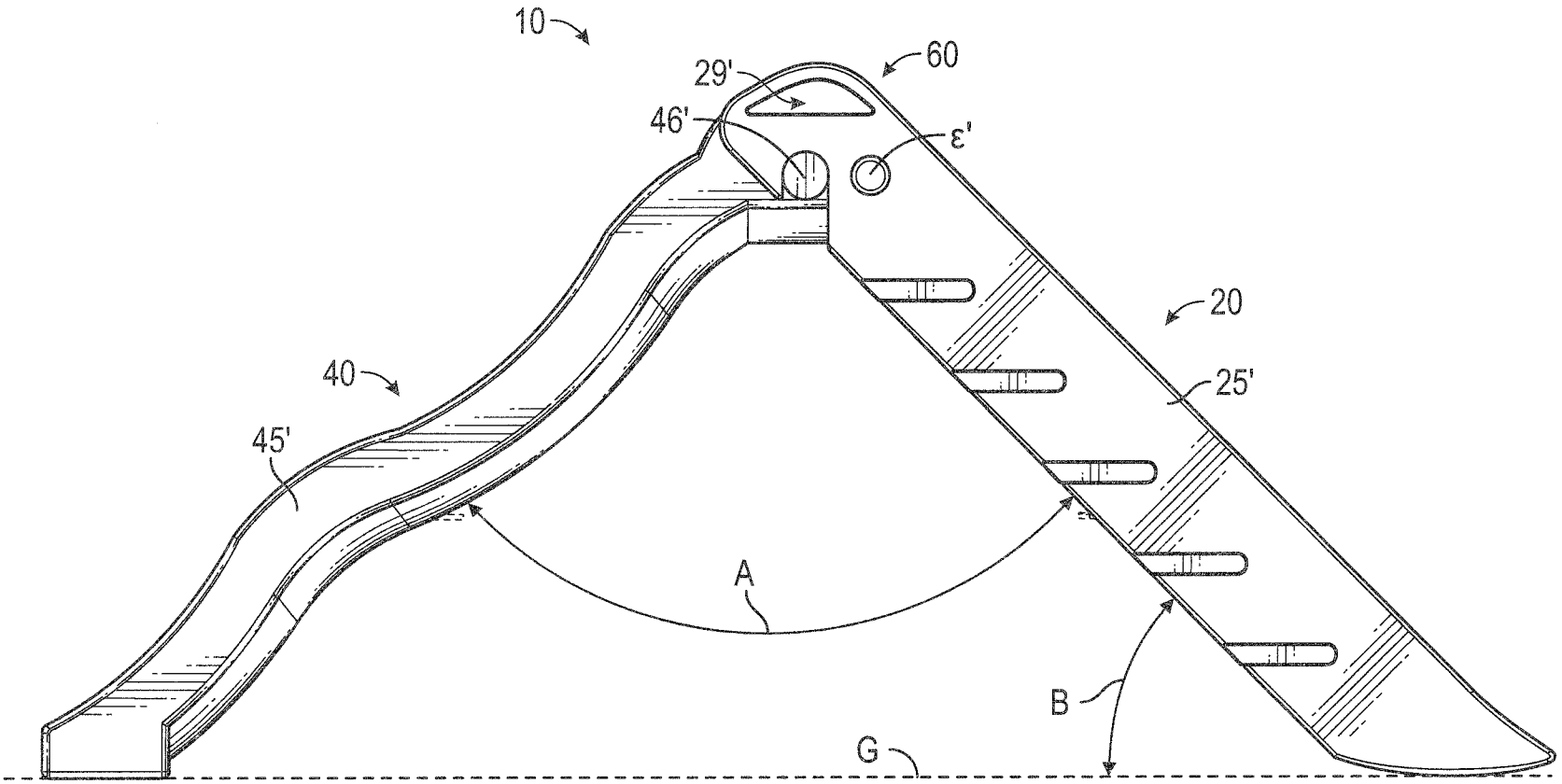
FIG. 4 is a left side view of the combined ladder and slide unit of FIG. 1.
Figure 5:
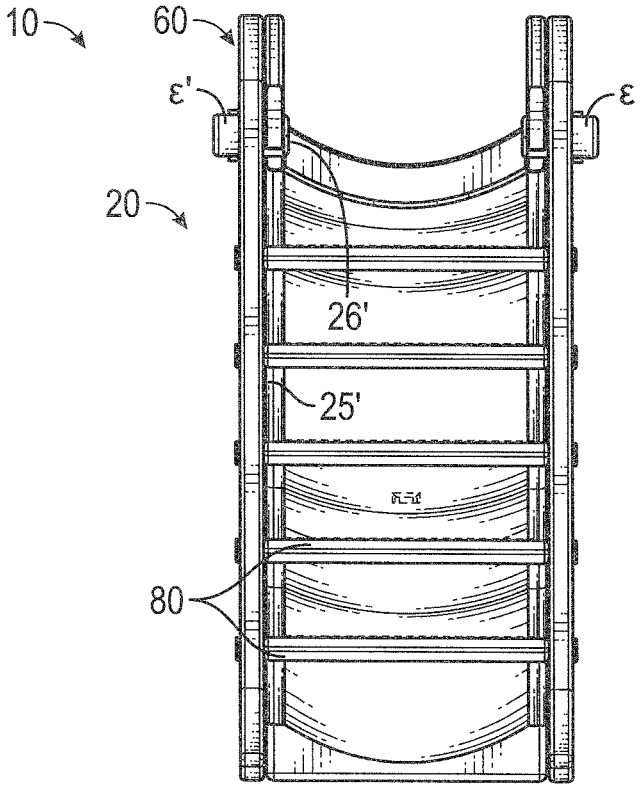
FIG. 5 is a rear view of the combined ladder and slide unit of FIG. 1.
Figure 6:
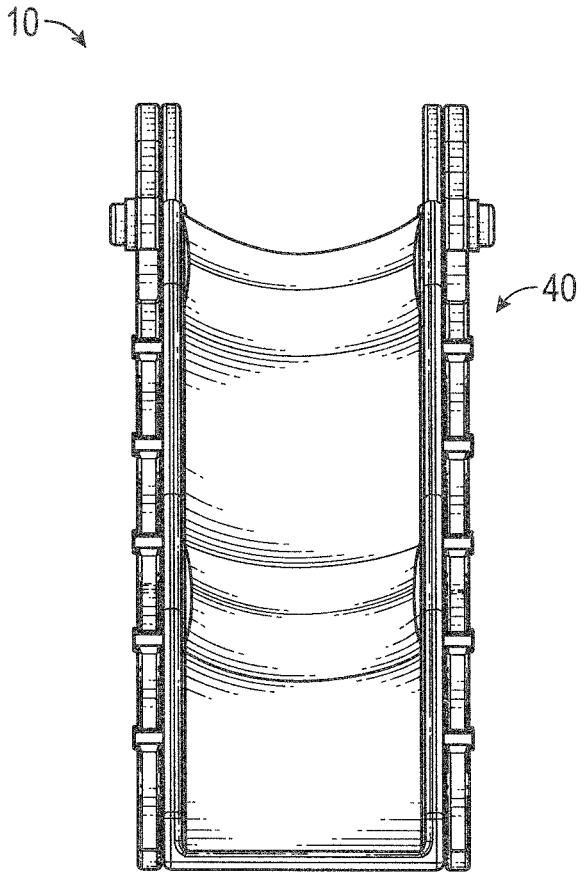
FIG. 6 is a front view of the combined ladder and slide unit of FIG. 1.
Figure 7:
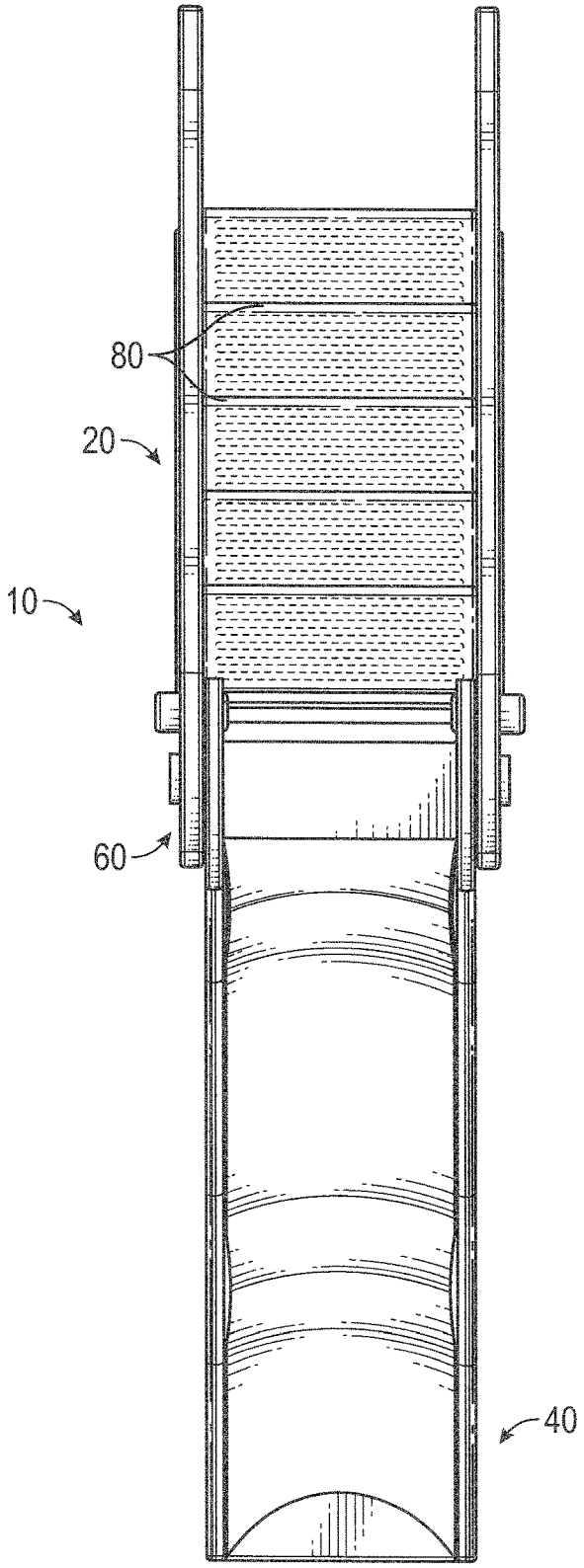
FIG. 7 is a top view of the combined ladder and slide unit of FIG. 1, wherein the front end of the slide is near the bottom of the page.
Figure 8:
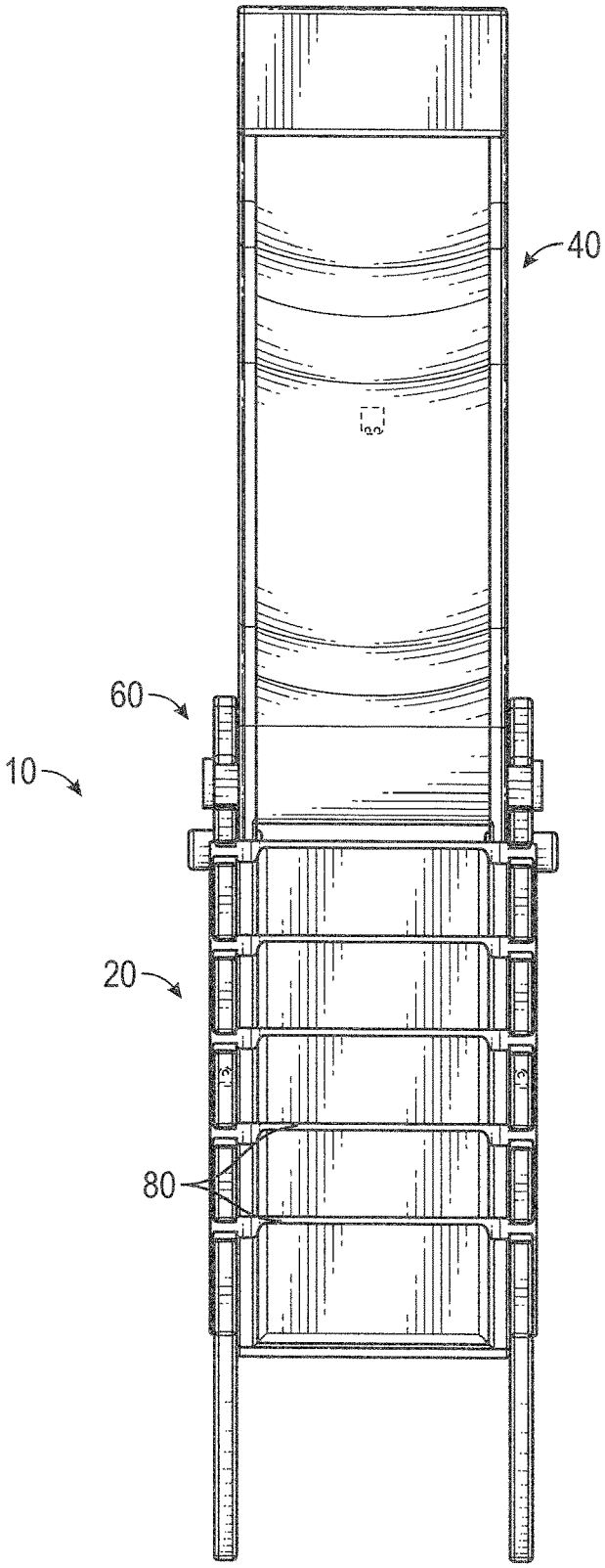
FIG. 8 is a bottom view of the combined ladder and slide unit of FIG. 1, wherein the front end of the slide is near the top of the page.
Figure 10:
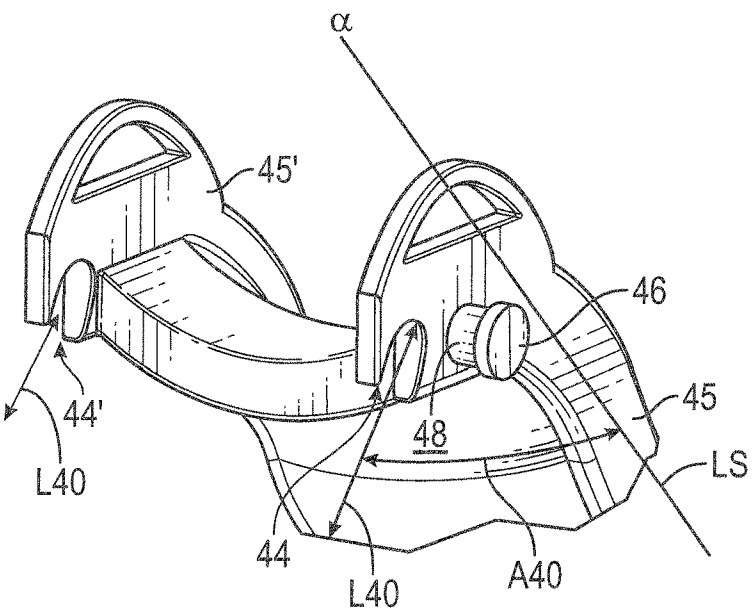
Figure 9:
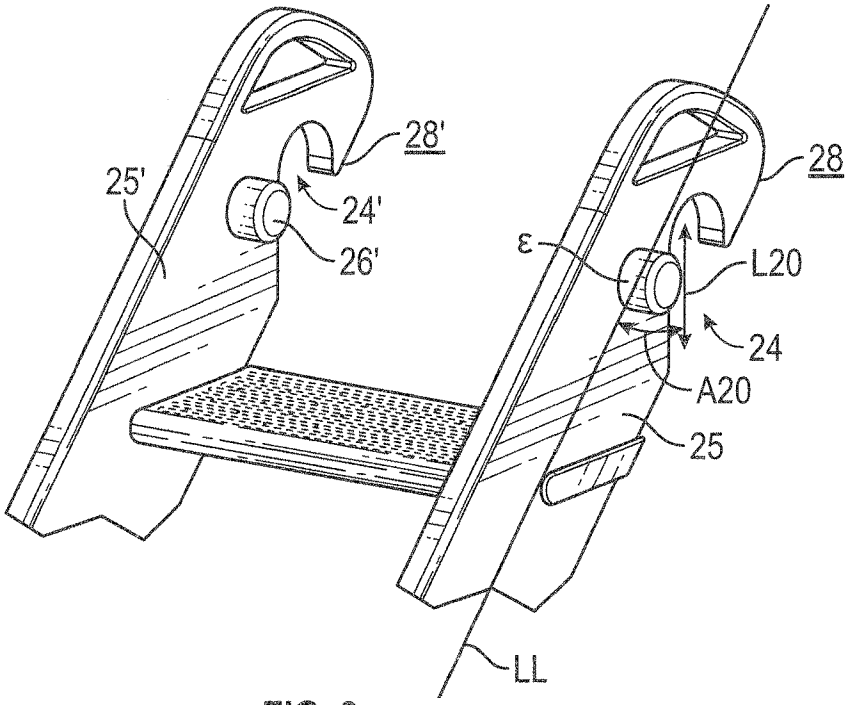

The combined unit 10 may be set up in an inverted-V shape, with bottom ends of both main portions 20, 40 resting/floor as in FIGS. 1-8. The combined unit 10 is preferably self-standing and independent of any other support or attachment except for being set on/resting on the ground/floor. Certain embodiments of the connection system allowing said self-standing and self-supporting deployment are a hook system 60, for example, as illustrated in FIGS. 9 and 10, adapted to maintain a desired angle between the main portions, during normal use of the unit 10. Said desired angle may be different, depending on the lengths of the main portions and the connection system design. For example, to provide a safe but fun experience, certain embodiments feature an angle A (FIGS. 1, 3, and 4) of the main portions relative to each other in the range of about 60-90 degrees, and more preferably about 70-80 degrees. This will result, for generally equal-length ladder 20 and slide 40 portions, in each of the ladder 20 and the slide 40 being at an angle B, B' (FIGS. 1, 3, and 4) to the ground G in the range of about 45-60 degrees, or more preferably in the range of about 50-55 degrees. For equal length ladder and slide portions, angle B will be the same as angle B', or for generally the same length ladder and slide portions angle B will be generally the same as angle B' (within 1-10 degrees of angle B', for example), and the top ends of the ladder and slide will typically be centered (or generally centered) over the bottom ends of the ladder and slide, which will contribute to stability of the device and to safe play.

Gravity and the hook system 60 design keep the two main portions 20, 40 in a stationary position relative to the ground and relative to each other, until a parent or other person purposely takes down the device by unhooking the main portions from each other. The weight of the main portions of the device, and the weight of any user on the device, by force of gravity, will tend to push/keep the ladder, slide, and their respective hooks in proper position, for example, forcing the hooks down in proper positions on/around their respective pegs/posts. But, for quick take-down of the device, an adult or other supervising person, may lift the main portions 20, 40, and unhook the hooks on each of the main portions from the cooperating axle pegs/posts on each of the main portions. This way, the adult/supervisor may separate the ladder and the slide from each other for easy transport to another location and/or to storage. The preferred hook system 60 will be detailed later in this document.

Figure 11:
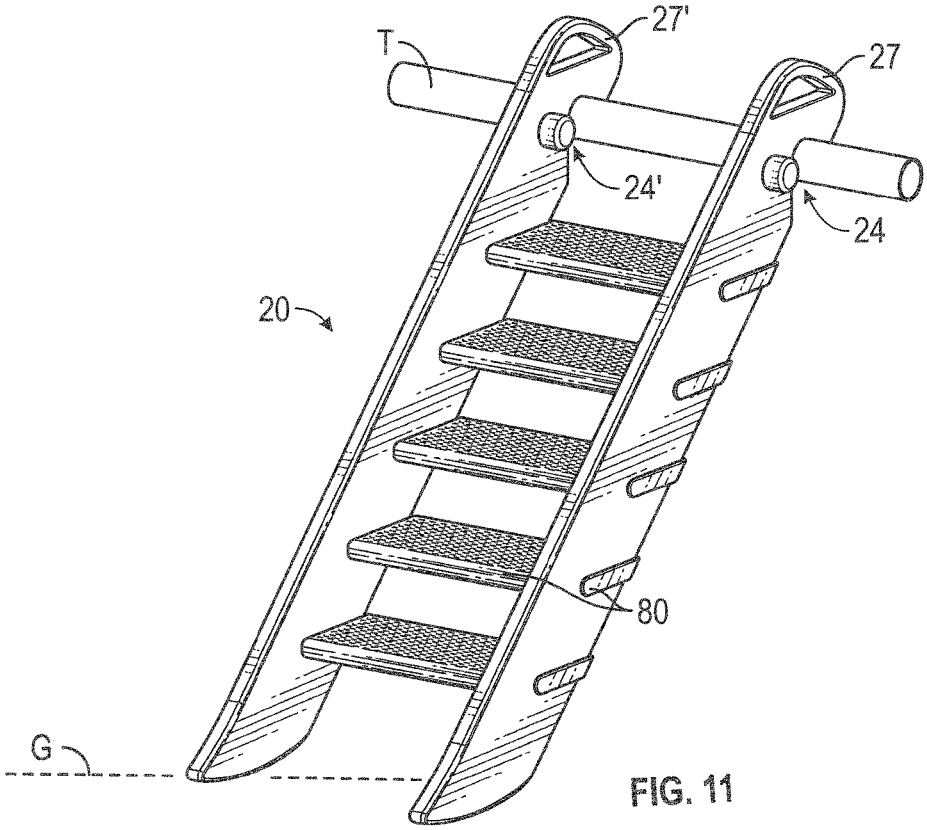
FIG. 11 is a right side, rear perspective view of the ladder portion of the embodiment of FIG. 1, connected to a horizontal tube/post so that the ladder portion is in a hanging configuration hanging at its top end from the tube/post and resting at its bottom end on the floor/ground.
Figure 12:
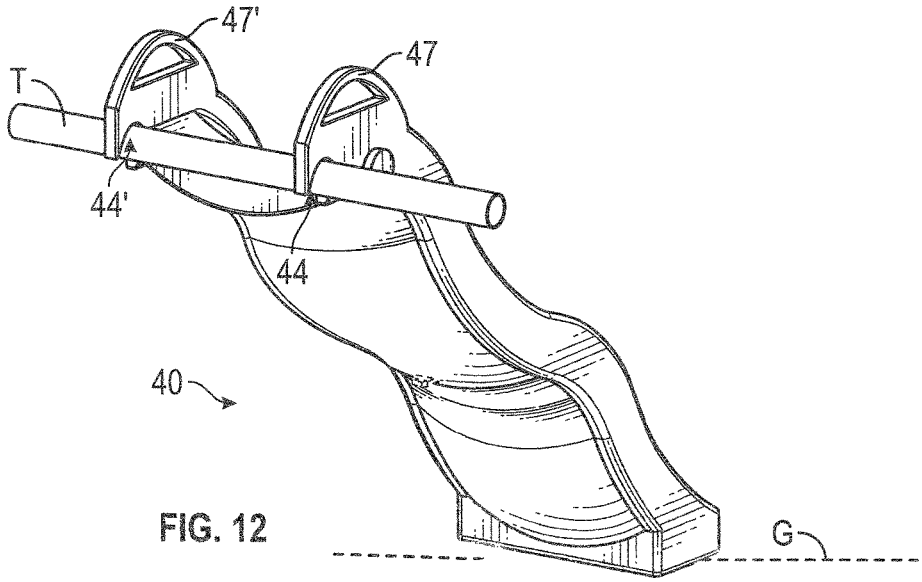
FIG. 12 is a left side, rear perspective view of the slide portion of the embodiment of FIG. 1, connected to a horizontal tube/post so that the slide portion is in a hanging configuration hanging at its top end from the tube/post and resting at its bottom end on the floor/ground.

The main portions (ladder 20 and slide 40) may be detached from each other, for use of one or both of the portions individually connected to another object or objects, for example, to tubing, bar(s), post(s), bracket(s), and/or other member(s). For example, as illustrated by FIGS. 11 and 12, the top ends of the ladder and/or slide may be separately/independently installed tubing T, or other structure, of various platforms or other elevated locations, to provide climbing access to, and sliding egress from, said platforms/locations.

Figure 13:
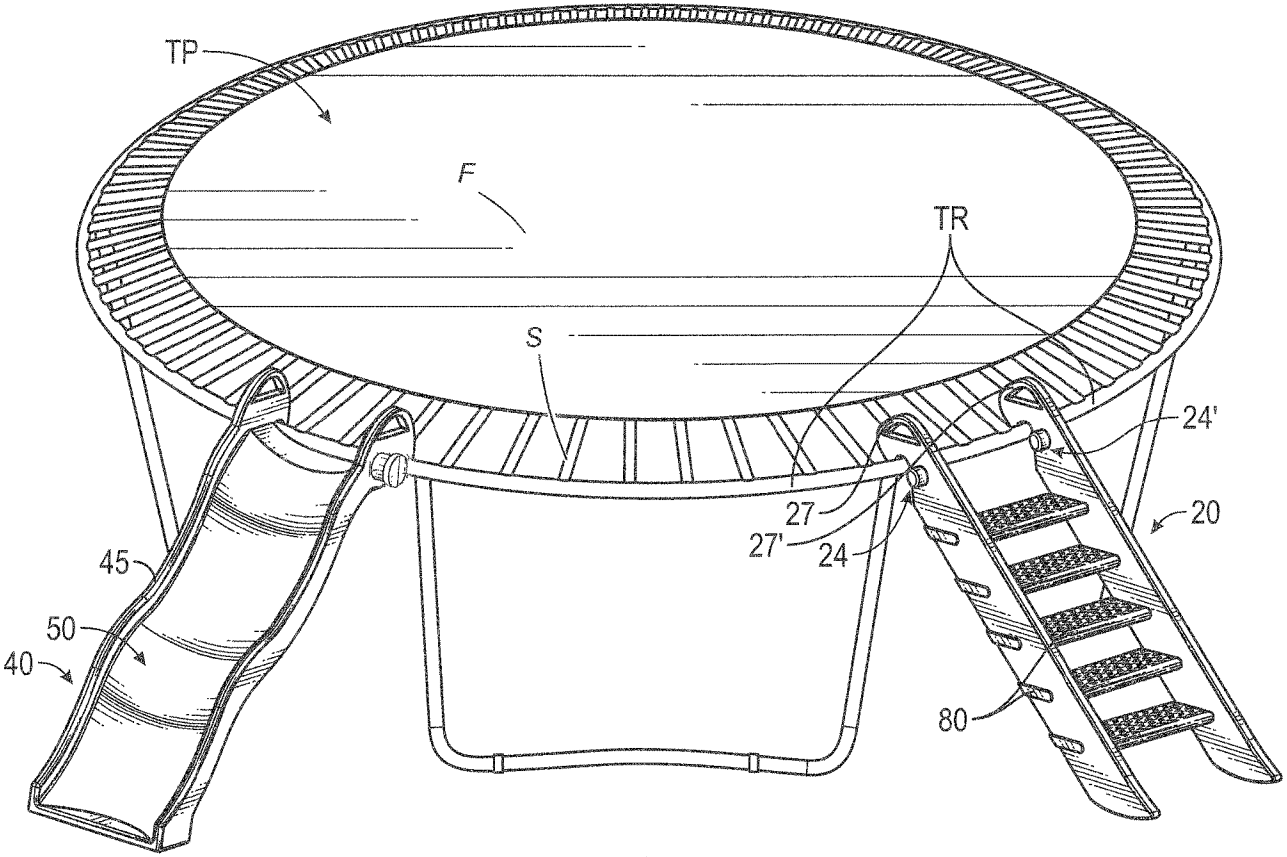
FIG. 13 is a top perspective view of the ladder portion and the slide portion of the embodiment of FIG. 1, disconnected from each other and hooked onto the horizontal perimeter bar of the support frame of an exemplary trampoline, so that each of the ladder portion and the slide portion is in a hanging configuration hanging at its top end from the tube/post and resting at its bottom end on the floor/ground.
Figure 15:
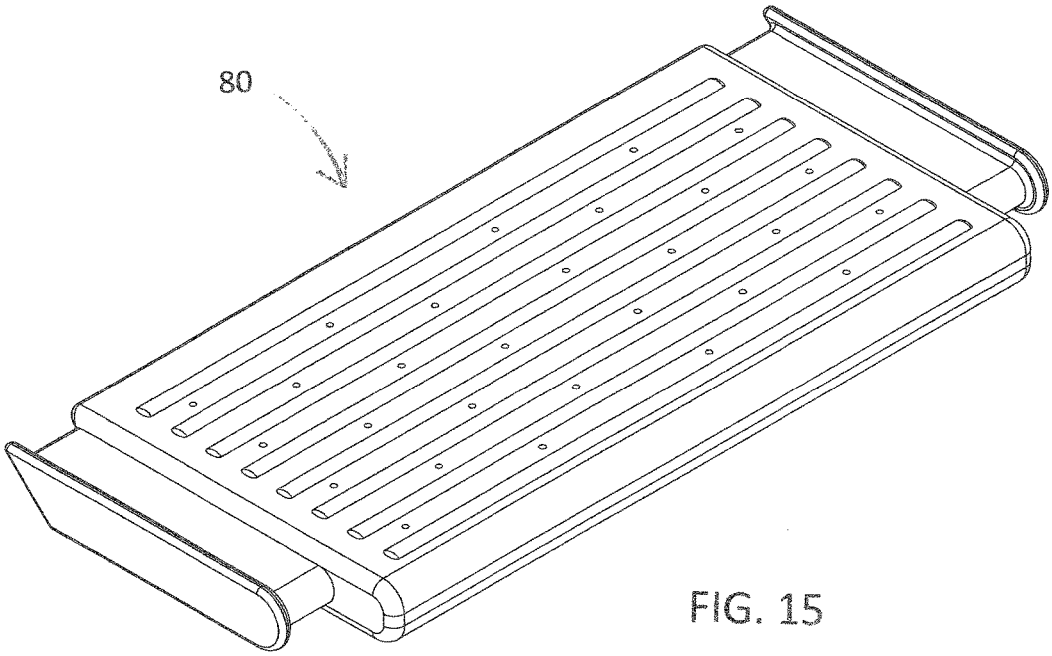
FIG. 15 is a rear left side perspective view of one embodiment of a ladder step, such as may be used in the ladder portion of FIGS. 1-9, 11, 13, and 14.

A particularly beneficial installation of the separated ladder and slides 20, 40 is to install the portions 20, 40 in the same vicinity, for example, connected to different portions of a trampoline that are located a few feet away or diagonally across the trampoline, as illustrated in FIG. 13. It is envisioned that each of the ladder and slides may be installed/connected at many locations around the trampoline TP. For example, the preferred hook system 60 allows hooking of the ladder and slide 20, 40 around the horizontal, outer-perimeter bar or "trampoline rim" TR of the trampoline support frame, as illustrated in FIG. 15. The hooks of each of the ladder 20 and the slide 40 may be installed around the trampoline rim TR between the springs, ties, and/or other connectors S that typically connect the trampoline fabric F to the trampoline rim TR. Thus, the ladder and the slide may be installed separately on the same trampoline, at adult-chosen convenient locations, so that a trampoline user may climb up the ladder to jump on the trampoline and then slide down when tired or otherwise done with a session of trampoline use.

Thus, an especially-preferred method of using the separated main portions 20, 40 of the device is to install them at/near the outer perimeter/edge of a trampoline to allow a trampoline easy and safe access to, and egress from, the trampoline. This prevents make-shift objects and methods of getting up onto, and/or getting down from, the trampoline, such as climbing on boxes, chairs, or unsecured steps/ladders, and/or jumping down all the way to the ground. This is especially important for younger users, and will help prevent accidents due to the ladder and slide being securely and safely attached to, at safe angle(s) relative to, the trampoline. The fun of using a slide to leave the trampoline will encourage safe and consistent behavior when leaving the trampoline.

FIGS. 1-8 show the combined unit 10 in its deployed, self-standing, and self-supporting configuration. In ladder portion (or simply, "ladder") 20, multiple steps 80 are installed in or otherwise secured to parallel, spaced-apart sides 25, 25'. In slide 40, parallel, spaced-apart right and left sides 45, 45' are fixed or otherwise secured to main slide body 50 or "slide plate". Sides 25, 25' serve as handrails for the s climbing user. Sides 45, 45' served as handrails for the sliding user and also as limits/stops to prevent the user from sliding off an edge of the slide. Top grips 27, 27', 47, 47' of sides 25, 25', 45, 45', and their apertures 29, 29' are aligned in the deployed, self-standing, and self-supporting configuration of FIGS. 1-8, and may be used as handgrips as the user approaches the top of the ladder and transitions over the top of the unit 10 to slide down the slide 40. Both sides 45, 45' and the slide plate 50 preferably wavy/curved to provide both a fun sliding experience and a safe sliding speed.

Figure 14:
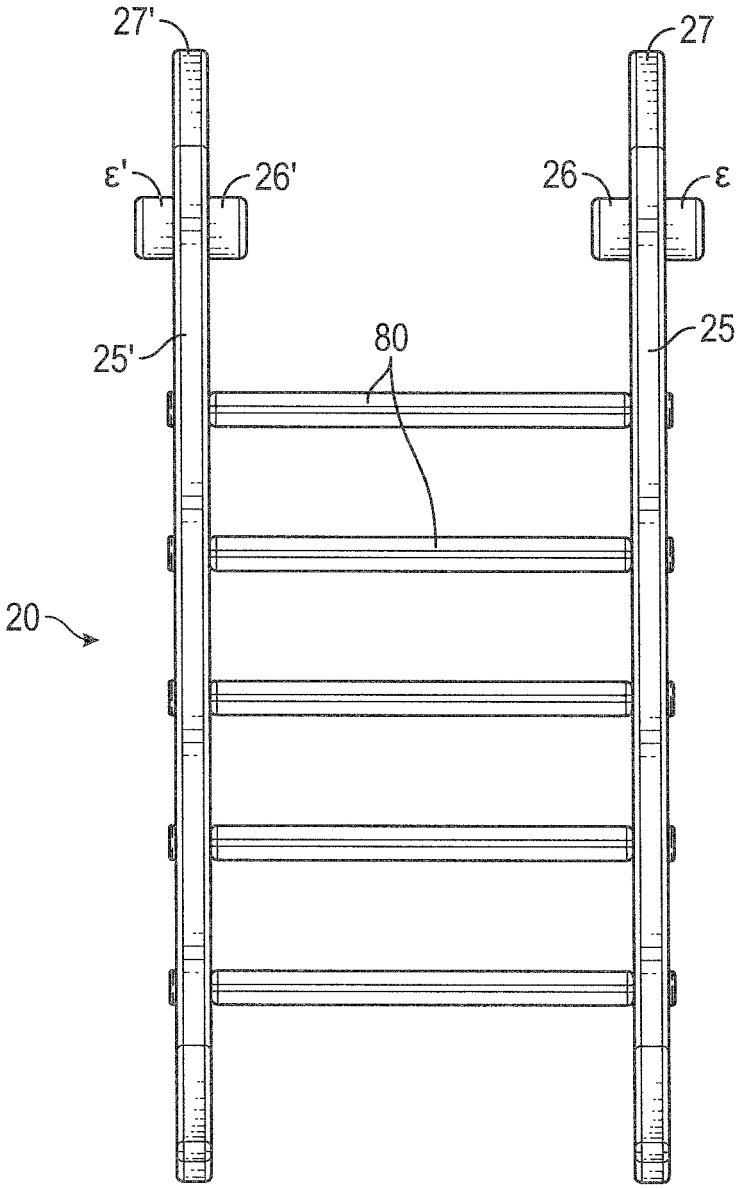
FIG. 14 is a rear view of the ladder portion of the embodiment of FIG. 1, detached from the slide portion and from any horizontal tube/post/bar, the ladder being at the same angle to the ground as in FIG. 1-8, so that the ladder steps are generally horizontal.

The top ends of the right and left sides 25, 25' of the ladder 20, and the top ends of the right and left sides 45, 45' of the slide 40, comprise elements that cooperate as a hook-based connection system connecting portions 20, 40 in FIGS. 1-8. The individual hook system 60 elements of each of the portions 20, 40 are shown to best advantage in FIGS. 9, 10 and 14. The top ends of said right and left sides 25, 25' of the ladder 20 comprises right and left interior pegs 26, 26', respectively. These interior pegs 26, 26' extend inward horizontally from the right and left sides 25, 25', and are received in hooks 44, 44', respectively, of the top ends of sides 45, 45' of slide 40. The top ends of said right and left sides 45, 45' of the slide 40 also comprise exterior pegs 46, 46', which extend outward horizontally from the right and left sides 45, 45' for being in received in hooks 24, 24' of the ladder 20.

Thus, the hooks 24, 24' of the ladder 20 hook-over/engage the exterior pegs 46, 46' on the outside of the slide 40 top ends. The hooks 44, 44 of the slide 40 hook-over/engage the interior pegs 26, 26' on the inside of the ladder 20 top ends. It is of interest to note that the slide 40 has only exterior pegs, and not interior pegs. It is of interest also to note that the ladder 20 has interior pegs 26, 26', which are used in the hook system 60, but also has exterior pegs E, E' that are not used in the connection system 60 in the configuration shown in FIGS. 1-8. Exterior pegs E, E' are provided on the ladder 20, because the right and left sides 25, 25' are preferably made to be the same shape and size and have the same features, substantially or entirely identical, so that they are interchangeable in the ladder 20. One will see in FIGS. 15 and 16 that the steps 80 are preferably removable from the right and left sides 25, 25' for storage or transport. The identical nature of the sides 25, 25' allows them to be swapped in place in the ladder 20, if desired and/or by chance. Thus, if the right side 25 and left side 25' are switched, the previously exterior pegs E, E' then become the new interior pegs 26' and 26, respectively. Because the portrayed embodiment of the slide 40 is manufactured as a unitary piece wherein the sides 45, 45' are not detachable from the slide main body 50 and so are not interchangeable/switchable, the sides 45, 45' have only the exterior pegs 46, 46' that are used in the connection system 60.

To connect the portions 20, 40, from their positions shown in FIGS. 9 and 10, the portions are rotated so that their longitudinal axes are more parallel to each other than shown in FIGS. 9 and 10, to place the bottom ends of the portions 20, 40 closer together. This allows the hooks 44, 44' to slide over interior posts 26, 26', without the front hook surfaces 28, 28' at the front sides of the hooks 24, 24' hitting the back side surface 48 of the exterior pegs 46, 46'. Backside surface 48 is visible on peg 46 in FIG. 10 and it will be understood that there is an analogous backside surface of peg 46' that is not visible in FIG. 10. With the portions 20, 40 close to parallel to each other, hooks 44, 44' can slide around pegs 26, 26', with the front hook surfaces 28, 28' above the pegs 46, 46', thus "clearing" the pegs 46, 46'. Then, once pegs 26, 26' are in hooks 44, 44', the ladder and slide 20, 40 may be pivoted away from generally parallel (moving their bottom ends away from each other to the desired angle A in FIGS. 1 and 3), which will pivot the ladder hooks 24, 24' forward over and around the pegs 46, 46' to complete the hooked connection. In this completed-connection configuration, each set of hooks rests over its own set of pegs, and the portions 20, 40 are in their desired, self-standing orientation, for example, as in FIGS. 1-8.

Therefore, this hook connection system 60 creates what may be called a double-hook/double-axle system. Hooks 24, 24' receiving pegs 46, 46' form a first axle that extends through the central axis of each of pegs 46, 46'. Hooks 44, 44' receiving pegs 26, 26' form a second axle that extends through the central axis of each of pegs 26, 26'. Thus, in the combined ladder and slide set-up of FIGS. 1-8, these two axles are generally horizontal, and are parallel on the same or about the same horizontal plane, but spaced apart. The two axles are spaced apart by about the distance between the centerline of pegs 46, 46' and the center of the interior space of hooks 44, 44', which is also about the distance between the centerline of pegs 26, 26' and the center of the interior space of hooks 24, 24'. Thus, in the combined ladder and slide unit 10, there are two axles that are at locations and relative positions that prevent downward force on the ladder or the slide from causing any relative rotation, or that prevent significant relative motion, of the slide and the ladder. This double-axle system thus prevents, or greatly minimizes, such downward force from moving the bottom ends of the ladder and the slide apart. It is preferred that the device 10 be adapted, preferably by means of the hook connection system 60 being adapted, and the portions 20, 40 being substantially rigid or entirely rigid, so that such downward force will move the ladder and slide bottom ends apart only from 0 to 2 inches, and more preferably only 0 to 1 inch, and most preferably 0 inches.

The term "hooks" as used herein and referenced as numbers 24, 24', 44, 44' will be understood to be circular or curved structures forming and defining interior spaces (and openings into the interior spaces), for receiving tubing, posts, bars, brackets or other members, for example, for connecting the portions 10, 20 together at their top ends or hanging/supporting the portions 10, 20 on said tubing, posts, bars, brackets or other members.

The hook connection system 60 is specially adapted in ways that results in surprisingly convenient, sturdy, safe and reliable connection and disconnection without tools and without separate/added lock(s), tie(s), clamp(s) or other fastener(s).

This adaptation comprises the openings and interior spaces of hooks 44, 44' being positioned and angled differently than the openings and interior spaces of hooks 24, 24'. For example, hooks 44, 44' are shaped so that their interior spaces open generally rearward, rather than the generally straight-downward openings/interior spaces of hooks 24, 24'. As shown in FIG. 9, the preferred hook 24, 24' interior space/opening extends approximately vertical when the ladder is set up for use, for example, the hooks 24, 24' have a length axis/dimension L20 that is approximately or exactly at 45 degrees (for example, 40-50 degrees) to the longitudinal axis LL of the sidewalls/sides of the ladder. As shown/described in FIG. 10, the hook 44, 44' interior space/opening extends approximately at 45 degrees to vertical when the slide is set up for use, for example, the hooks 44, 44' have a length axis/dimension L40 that is approximately or exactly at 90 degrees (for example about 80-90 degrees), to the longitudinal axis LS of the slide/slide main body/and sidewalls of the slide.

Disconnection may be done by a process that is generally the reverse of the connection process. From the configuration of FIGS. 1-8, the ladder and slide 20, 40 are purposely lifted or tipped over, which then allows the ladder and slide 20, 40 to be purposely pivoted relative to each other to bring the bottom ends of the portions 20, 40 closer together so that the portions 20, 40 are nearly parallel. As this pivoting is done, hooks 44, 44' remain over exterior pegs 26, 26', with the interior pegs 26, 26' rotating inside the hooks 44, 44'. The pivoting, however, moves hooks 24, 24' up and rearward relative to pegs 46, 46' to remove the hooks 24, 24' from exterior pegs 46, 46'. With the hooks 24, 24' having cleared (left) the pegs 46, 46', the ladder 20 and slide 40 can be separated, and in doing so, hooks 44, 44' leave/slide-off interior pegs 26, 26'.

Figure 16:
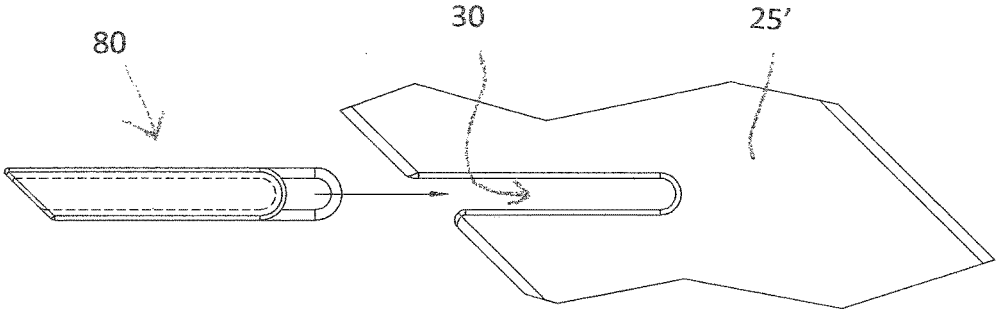
FIG. 16 is a left side view of the step of FIG. 15 being installed into a side piece of the ladder portion.

Each of the right and left sides 25, 25' of the ladder 20 is preferably a plate-like structure, that is, substantially longer and wider than thick. Each of the steps 80 is preferably a plate-like structure, that is, substantially longer and wider than thick, as shown to best advantage in FIGS. 14-16. Thus, each of the right and left sides 25, 25' and each step 80 may be said to have a "main plane" or "central plane". FIG. 15 shows a rear perspective view of a step 80, and FIG. 16 shows the step being inserted into the slots 30 of the sides 25, 25'. The steps will thereby be secure in the slots 30, for example, by snap-fit, friction fit, and/or interference fit between the step 80 and the surface(s) of the slot 30, or other/additional optional fastening. While the steps are secure in the slots and will not tend to slide out of the slots during use, it is desirable in many embodiments for an adult to be able to remove the steps from the sides 25, 25' using normal strength, for storage or transport.

During normal use of the ladder 20, either in the combined unit 10, or as a separate piece, the steps are installed in and connect the right and left sides 25, 25'. The main plane of each step is transverse to the main plane of each of the right and left sides, and parallel to the main planes of all the other steps. Each step is generally, substantially, or entirely horizontal (see FIGS. 3-5 and 14) so that the top surface of each step may be used as a step for supporting a climber of the ladder, and particularly the foot/feet of the climber. The orientation of the steps relative to the ground may vary depending on the unit's 10 or the portion's 20 position on the ground, a patio, or other generally horizontal but not perfectly horizontal surface. For example, one or more of the steps may be slightly slanted from exactly-horizontal with the forward edge of the step slightly lower than the rearward edge of step, for example, due to the ladder resting on an uneven/slanted surface and/or to help ensure that the climber's foot will not slip rearward off the step. The top surface of each step may be textured, ridged, or otherwise adapted to enhance the climber's foot gripping, or at least not sliding off of, said top surface. It is preferred that the main plane and the top surface of each installed, in-use step are each in the range of exactly horizontal plus or minus up to and including 10 degrees, and more preferably plus or minus up to and including 5 degrees.

In the in-use configuration of FIGS. 1-8, for example, the main plane of each of the right and left sides of the ladder are vertical, but the longitudinal axis of each of the right and left sides are slanted relative to horizontal and relative to vertical. For example, said longitudinal axis of each of the right and left sides is preferably orientated to be in the range of about 45-60 degrees from exactly horizontal, and more preferably in the range of about 50-55 degrees from the ground; see angle B in FIGS. 1, 3 and 4. Such orientation will allow comfortable climbing especially in view of the climber being able to grasp and use the right and left sides, and particularly their upper edges, as hand-rails.

The slide 40 also comprises right and left sides 45, 45' that are each preferably a plate-like structure, that is, substantially longer and wider than thick. The main slide body 50 is preferably generally a plate-like structure, that is, substantially longer and wider than thick, but is preferably slightly curved along its length in an undulating form to provide some additional fun and slight up and down movement as the slider goes down the slide. Further, the undulating may also slow the slider slightly for safety, while making it a fun experience. Thus, each of the right and left sides 45, 45' may be said to have a "main plane" or "central plane", and the main slide body 50 may be said to have a "main plane" or "a central plane" from end to end through the undulations.

Each of the right and left side 45, 45' of the slide 40 and their respective main planes are transverse to the main plane of the main slide body 50. In the in-use configuration, the main plane of each of the right and left sides 45, 45' of the slide are vertical, but the longitudinal axis LS of each of the right and left sides are slanted relative to horizontal and relative to vertical. Also, the main plane of the main slide body 50 is slanted relative to horizontal and relative to vertical. For example, said longitudinal axis of each of the right and left sides of the slide, and the main plane of the main slide body is preferably orientated to be at an angle B' (FIGS. 1 and 3) to the ground in the range of about 45-60 degrees, or more preferably in the range of about 50-55 degrees. Such orientation will allow comfortable, fun, and yet safe sliding, especially in view of the slider being able to grasp and use the right and left sides of the slide, and particularly their upper edges, as hand-rails.

As discussed above, the preferred embodiment can be taken apart, with ladder and slide 20, 40 separated and the steps 80 removed from the sides 25, 25' of the ladder. This way, these separated parts can be stacked with their main planes parallel or generally parallel, in a box, on a shelf, stacked/layered in a corner or against a wall, or even/rested on hooks or shelves in a garage or other storage unit. The device does not have to remain set up in its in-use configuration and may be stored compactly.

By viewing FIGS. 9-12, it will be understood that ladder 20 and slide 40, when separated from each other, may be connected to other structure, for example, by each portion's hooks 24, 24' or 44, 44' engaging tubing, posts, bars, brackets or other members. In FIGS. 11 and 12, the ladder 20 and slide 40 separately and independently hook onto two different portions of tubing/post T. In FIG. 13, the ladder 20 and slide 40 separately and independently hook onto two different portions of trampoline rim TR. It will be understood that the ladder 20 and slide 40 shown in FIGS. 11-13 may be said to be "hanging" from the tubing/post T or rim TR, but with the bottom ends of the ladder and slide resting on the floor/ground G, to place the ladder and slide each at an angle to the floor/ground that is desirable for safe and comfortable use. For example, this angle may be the same as the angle of the ladder (angle B) and the angle of the slide (B') in the self-standing configuration. Or, this angle may be generally the same (within 1-10 degrees) as the angle of the ladder (angle B) and the angle of the slide (B') in the self-standing configuration. Thus, FIGS. 11 and 12 and the trampoline example in FIG. 13, illustrate some but not all embodiments of a "hanging configuration" wherein the two separate ladder and slide portions hang from tubing, posts, bars, brackets or other members, to extend between and contact said tubing, posts, bars, brackets or other members and the floor/ground. While the floor/ground is not drawn and labeled in FIG. 13, it may be understood that the bottom of the trampoline support frame and the bottom ends of the ladder and slide are resting on the floor/ground.

While the tubing/post T of FIGS. 11 and 12 is shown as being a short length, it will be understood that the tubing/post T, or other bar/brackets for being received in the hooks of the portions 10, 20, may extend horizontally any distance from the portions 10, 20. For example, the ends of the tubing/post T may extend feet or yards away from the portions 10, 20. Alternatively, the tubing/post T, or other bar/brackets may extend only a short distance beyond the right and left sides of the portions 10, 20, for example, with the ends of the tubing/post T fixed to the object to which the user is climbing, or from which the user is sliding, by connectors, fasteners, or other means.

FIGS. 11 and 12 portray tubing/post T as straight and cylindrical, which fits well into the hooks 24, 24', 44, 44' in a similar manner as the cylindrical pegs/posts 46, 46', 26, 26', in the combined unit confirmation of FIGS. 1-8. However, in certain embodiments, other shapes of tubing, posts, bars, brackets or other members may be received in and support the hooks, such as square, oval, C-shaped, X-shaped, or other cross-section shapes and/or even hook-receiving holes/apertures in the object to which the ladder or slide is being connected. Further, in certain embodiments, longitudinally-curved tubing, posts, bars, brackets or other members may support the hooks, such as large-diameter rings that have slight curvature that will fit into both of the hooks on a given portion 20 or 40. It may understood from this disclosure that the interior space and opening into the interior space of each hook, and the spacing of the sets of hooks 24 and 24', 44 and 44', and the diameters of the cooperating cylindrical pegs/posts 46, 46', 26, 26', may be adapted so that the ladder and slide effectively cooperate with each other, while the hooks can also fit onto and cooperate with various tubing, posts, bars, brackets or other members. For example, the hooks 24 and 24', 44 and 44' fit onto and cooperate with the circular, cylindrical-tubing, trampoline rim TR of the trampoline support frame in FIG. 13. While the rim TR is curved on a radius, the radius is so large (for example, typically 4-8 feet in radius) that said hooks work well with the rim TR. Also, the hooks hold the ladder and slide at a desirable angle relative to the ground, that is similar or the same as their angles to the ground B, B', described above, when they are combined into the unit of FIGS. 1-8. Further, the hooks hold the ladder and slide so that the top grips 27, 27', 47, 47' are above the level of the trampoline fabric F and may be used as handgrips to stabilize and assist the user when he/she is moving from the ladder 20 to the trampoline fabric F and from the trampoline fabric F to the slide.

The preferred device is especially beneficial to those who want or need to accomplish multiple functions. This may be because children of different ages, capabilities, and/or interests are in the household, or the neighborhood. Or, it may be because a parent likes the self-standing slide feature, but looks forward to having a trampoline in the future, for example, when the children are a few years older. For example, the self-standing slide may be used inside, in a home, daycare, or children's exercise "gym". Then, for different occasions or different children, the device may be moved outside for use with a trampoline.

The preferred device may be made entirely of molded polymer ("plastic"), but may be additional/other materials if desired. The preferred ladder 20 and slide 40 are made with curved/rounded edges and corners, so that any accidental falling on the ladder or slide will be unlikely to cause harm. The device may be molded/formed with hollow interior regions, to reduce weight. Waterproof materials are preferred, due to trampolines typically being installed outdoors.

Certain embodiments may be described as: A multifunctional slide and ladder device comprising: a ladder having a top end and a bottom end; a slide having a top end and a bottom end; and the ladder and slide top ends comprising a connection system; wherein, in a self-standing configuration of the device, the top ends of the ladder and slide are connected together by the connection system, the bottom ends of the ladder and slide rest on a floor or ground, each of the ladder and the slide is at an angle to the floor or ground, and the tops ends are generally centered over said bottom ends, for use of the device in the self-standing configuration for climbing up the ladder to slide down the slide; and wherein, in a hanging configuration of the device, the ladder and slide are disconnected from each other, and the top ends of each of the ladder and slide are connected to a platform at a distance from each other, and the bottom ends of each of the ladder and slide are on the floor or ground, for use of the device in the hanging configuration for climbing up the ladder to the platform and for sliding down the slide from the platform to the ground. In certain embodiments, each of the ladder and the slide, when the device is in the hanging configuration, is at an angle to the floor or ground that is generally the same as said angle of each of the ladder and the slide in the self-standing configuration. In certain embodiments, said connection system comprises a hook system adapted to hook the ladder and slide together so that in the self-standing configuration the ladder and slide are not pivotable to move the bottom ends away from each other. Further, in certain embodiments of the hook system, said connection system is adapted so that disconnection of the ladder and the slide requires unhooking of multiple hooks on the ladder from the slide, and unhooking of multiple hooks on the slide from the ladder, and said unhooking requires the ladder and slide bottom ends to be brought closer together. Further, in certain embodiments of such a multiple hook system, said connection system comprises said multiple hooks on the ladder engaging multiple protrusions on the slide top end, and said multiple hooks on the slide engaging multiple protrusions on the ladder top end. Said platform may be a trampoline with a perimeter rim, and the ladder and slide top ends, in the hanging configuration, may each be separately connected to the perimeter rim. The ladder may comprise two side pieces and steps secured between the two side pieces, wherein the steps are disconnectable from the two side pieces for compact storage of said two side piece and said steps, and in some embodiments, the two side pieces are identical and are interchangeably securable to opposites ends of the steps.

Certain embodiments may be described as: A multifunction slide and ladder device comprising: a ladder having a bottom end and a top end and multiple steps for a user to step on for climbing up the ladder; a slide having a top end and a bottom end and a main slide body for a user to slide from the slide top end to the slide bottom end; and a connection system adapted to connect the top end of the ladder and the top end of the slide to hold the ladder and the slide in a self-standing configuration wherein the ladder and slide are at an angle relative to each other and the bottom ends of the ladder and slide are distanced from each other on a floor or ground, wherein said connection system prevents the ladder and slide from pivoting away from each other in the self-standing configuration so that said angle does not increase from weight being applied onto the ladder or the slide during use of the device for climbing and sliding; and wherein the connection system is adapted for disconnection of the ladder and the slide, when the device is not in use for climbing or sliding, by decreasing said angle between the ladder and the slide and separating the top ends of the ladder and slide. In certain embodiments, the connection system is a hook system wherein the ladder top end hooks onto protrusions on the slide and the slide top end hooks onto protrusions on the ladder, the protrusions on the slide being horizontally distanced from the protrusions on the ladder when the device is setup in the self-standing configuration, so that the ladder and slide cannot pivot relative to each other to increase distance between the ladder and slide when in said self-standing configuration. In certain embodiments, the connection system comprises each of the top end of the ladder and the top end of the slide comprising two hooks and two protrusions, and wherein, in the self-standing configuration, the two hooks of the ladder hook over said two protrusions of the slide, and the two hooks of the slide hook over said two protrusions of the ladder, and said two protrusions of the slide are distanced horizontally from said two protrusions of the ladder, so that the ladder and slide in the hooked-together confirmation will not pivot apart at their bottom ends. In certain embodiments, the connection is a double-hook and double-axle connection system so that, once connected and placed in the self-standing configuration, weight of a user on the ladder and slide does not pivot the ladder or the slide and does not push the bottom ends of the ladder and slide farther apart. In certain embodiments, each of the top end of the ladder and the top end of the slide is adapted, when disconnected and separated, to hook over tubing, posts, bars, brackets or other members, for use of the ladder to climb onto a trampoline or other platform and for use of the slide to slide down from the trampoline or other platform, for example, wherein each of the top ends hooks over a circumferential trampoline rim of a support frame of the trampoline. The ladder may comprise, in certain embodiments, two side pieces and steps secured between the two side pieces, wherein the steps are disconnectable from the two side pieces for compact storage of said two side piece and said steps. The two side pieces may in some embodiments be identical and interchangeably securable to opposites ends of the steps.

Certain embodiments may be described as the following combinations and/or the methods of installing and/or using such a combination: A combination of a trampoline and a multifunction slide and ladder device, the combination comprising: a trampoline comprising a trampoline fabric supported above a floor or ground by a support frame; and a multifunction slide and ladder device comprising: a ladder having a top end and a bottom end; a slide having a top end and a bottom end; and the ladder and slide top ends comprising a connection system; wherein, in a hanging configuration of the device, the ladder and slide are disconnected from each other, and the top ends of each of the ladder and slide are connected to the trampoline at a distance from each other, and the bottom ends of each of the ladder and slide are on the floor or ground, for use of the device in the hanging configuration for climbing up the ladder to the trampoline and for sliding down the slide from the trampoline to the ground; and wherein, in a self-standing configuration of the device, the ladder and slide are disconnected from the trampoline and the top ends of the ladder and slide are connected together by the connection system, the bottom ends of the ladder and slide rest on the floor or ground, each of the ladder and the slide is at an angle to the floor or ground, and the connected tops ends are generally centered over said bottom ends, for use of the device in the self-standing configuration for climbing up the ladder to slide down the slide. In certain combinations, the connection system comprises the top ends of each of the ladder and slide having multiple hooks that hook over a circumferential rim of the support frame of the trampoline. In certain embodiments, the ladder comprises two side pieces and steps secured between the two side pieces, wherein the steps are disconnectable from the two side pieces for compact storage of said two side piece and said steps. The two side pieces may in some embodiments be identical and interchangeably securable to opposites ends of the steps.

Although this disclosed technology, including apparatus and methods and design features, has been described above with reference to particular means, materials and embodiments, it is to be understood that the disclosed technology is not limited to these disclosed particulars, but extends instead to all equivalents within the broad scope of the following claims.

The invention claimed is:

1. A multifunction slide and ladder device comprising:

a ladder having a bottom end and a top end and multiple steps for a user to step on for climbing up the ladder;

a slide having a top end and a bottom end and a main slide body for a user to slide from the slide top end to the slide bottom end;

and a connection system adapted to connect the top end of the ladder and the top end of the slide to hold the ladder and the slide in a self-standing configuration wherein the ladder and slide are at an angle relative to each other and the bottom ends of the ladder and slide are distanced from each other on a floor or ground, wherein said connection system prevents the ladder and slide from pivoting away from each other in the self-standing configuration so that said angle does not increase from weight being applied onto the ladder or the slide during use of the device for climbing and sliding; and wherein the connection system is adapted for disconnection of the ladder and the slide, when the device is not in use for climbing or sliding, by decreasing said angle between the ladder and the slide and separating the top ends of the ladder and slide; and wherein the connection system comprises each of the top end of the ladder and the top end of the slide comprising two hooks and two protrusions, and wherein, in the self-standing configuration, the two hooks of the ladder hook over said two protrusions of the slide, and the two hooks of the slide hook over said two protrusions of the ladder, and said two protrusions of the slide are distanced horizontally from said two protrusions of the ladder, so that the ladder and slide are in a hooked-together configuration that will not pivot apart at their bottom ends.

2. The device of claim 1, wherein each of the top end of the ladder and the top end of the slide is adapted, when disconnected and separated, to hook over tubing, posts, bars, brackets or other members, for use of the ladder to climb onto a trampoline or other platform and for use of the slide to slide down from the trampoline or other platform.

3. The device of claim 2, wherein each of the top end of the ladder and the top end of the slide is adapted to hook over a circumferential trampoline rim of a support frame of the trampoline.

4. The device of claim 1, wherein the ladder comprises two side pieces and steps secured between the two side pieces, wherein the steps are disconnectable from the two side pieces for compact storage of said two side piece and said steps.

5. The device of claim 4, wherein the two side pieces are identical and are interchangeably securable to opposites ends of the steps.

6. A combination of a trampoline and a multifunction slide and ladder device, the combination comprising:

a trampoline comprising a trampoline fabric supported above a floor or ground by a support frame; and a multifunction slide and ladder device comprising:

a ladder having a top end and a bottom end and multiple steps for a user to step on for climbing up the ladder;

a slide having a top end and a bottom end and a main slide body for a user to slide from the slide top end to the slide bottom end; and the ladder and slide top ends comprising a connection system;

wherein, in a hanging configuration of the device, the ladder and slide are disconnected from each other, and the top ends of each of the ladder and slide are connected to the trampoline at a distance from each other, and the bottom ends of each of the ladder and slide are on the floor or ground, for use of the device in the hanging configuration for climbing up the ladder to the trampoline and for sliding down the slide from the trampoline to the ground; and wherein, in a self-standing configuration of the device, the ladder and slide are disconnected from the trampoline and the top ends of the ladder and slide are connected together by the connection system, the ladder and the slide are at an angle to each other and the bottom ends of the ladder and slide are distanced from each other on the floor or ground, the connected tops ends are generally centered over said bottom ends, and the connection system prevents the ladder and slide from pivoting away from each other in the self-standing configuration so that the angle does not increase from weight being applied onto the ladder or the slide during use of the device for climbing and sliding; and wherein the connection system comprises each of the top end of the ladder and the top end of the slide comprising two hooks and two protrusions, and wherein, in the self-standing configuration, the two hooks of the ladder hook over said two protrusions of the slide, and the two hooks of the slide hook over said two protrusions of the ladder, and said two protrusions of the slide are distanced horizontally from said two protrusions of the ladder, so that the ladder and slide are in a hooked-together configuration that will not pivot apart at their bottom ends.

7. The combination of claim 6, wherein, in the hanging configuration, the two hooks of the ladder and the two hooks of the slide hook over a circumferential rim of the support frame of the trampoline.

8. The combination of claim 6, wherein the ladder comprises two side pieces and steps secured between the two side pieces, wherein the steps are disconnectable from the two side pieces for compact storage of said two side piece and said steps.

9. The combination of claim 8, wherein the two side pieces are identical and are interchangeably securable to opposites ends of the steps.

* * * * *